US005601178A

United States Patent [19]

Zaharia et al.

[11] Patent Number: 5,601,178

[45] Date of Patent: Feb. 11, 1997

[54] DETECTION OF ESCALATOR SAFETY CIRCUIT COMPONENT OPERABILITY

[76] Inventors: Vlad Zaharia, 35 Highland St., Rocky Hill, Conn. 06067; John Faup, 34 Berkshire Way, Simsbury, Conn. 06070

[21] Appl. No.: 405,475

[22] Filed: Mar. 16, 1995

[51] Int. Cl.[6] ..... B66B 25/00

[52] U.S. Cl. ..... 198/323

[58] Field of Search ..... 198/322, 323

[56] References Cited

U.S. PATENT DOCUMENTS

| | | | |
|---|---|---|---|
| 5,099,977 | 3/1992 | Hirose et al. | 198/323 |
| 5,107,975 | 4/1992 | Iwata | 198/323 |
| 5,186,300 | 2/1993 | Zaharia et al. | 198/322 |
| 5,295,567 | 3/1994 | Zaharia et al. | 198/323 |
| 5,526,256 | 6/1996 | Sakata et al. | 198/323 X |

FOREIGN PATENT DOCUMENTS

| | | | |
|---|---|---|---|
| 403158388 | 7/1991 | Japan | 198/323 |
| 404125293 | 4/1992 | Japan | 198/323 |
| 405070076 | 3/1993 | Japan | 198/323 |
| 405139679 | 6/1993 | Japan | 198/323 |

*Primary Examiner*—D. Glenn Dayoan

[57] ABSTRACT

A start up check relay is energized whenever escalator motor motive power is interrupted. The start up check relay checks speed and non-speed-dependent safety circuit components to determine whether these safety circuit components have all come to an escalator start up state. When the start up condition of these safety circuit components has been verified the circuit allows power to be applied to the escalator motor. When power is applied to the escalator motor, a start up delay timer is energized and the start up check relay is de-energized. When speed-dependent components of the escalator have come to operating speeds, the start up delay timer will be de-energized, and the escalator will continue movement in its normal operating mode provided that all safety circuits are fully operational.

16 Claims, 5 Drawing Sheets

DETECTION OF ESCALATOR SAFETY CIRCUIT COMPONENT OPERABILITY

TECHNICAL FIELD

This invention relates to a method and apparatus for checking escalator safety circuit components to confirm circuit operability prior to start up of motion of the escalator.

BACKGROUND ART

Escalators are provided with safety systems, each one of which is operable to stop movement of the escalator in the event that an unsafe operating condition is detected. Examples of such unsafe operating Conditions include: a missing step or a detached step on the escalator; a handrail which is moving at an improper speed; something becoming caught between adjacent steps or between the steps and the side skirts; a foreign object becoming lodged between the step treads and the combplate at the escalator exit landing; or the like. The safety system components used to detect unsafe escalator operating conditions include proximity sensors, switches, pressure sensors, or the like, which are able to detect unsafe escalator-operating conditions so long as the sensors and their associated circuitry remain operative. Present day escalators do not include any mechanism for determining the operability of the safety system detectors or their circuitry. It would be highly desirable to be able to detect safety circuit component failure prior to start up of the escalator. If a safety circuit component malfunction were detected, the escalator could be prevented from starting Up.

DISCLOSURE OF THE INVENTION

This invention relates to a system for checking escalator safety circuits to confirm the operability of the individual components in the safety circuits prior to starting the escalator. In the event that a safety circuit component is found to be in a condition which will not allow it to operate properly in the event of an unsafe occurrence, the safety checking system of this invention will prevent the escalator from starting up. The safety check system is equipped with a delay timer which is activated when the manual start up key is actuated by e workman attempting to start the escalator. By "start the escalator" is meant an activation of the escalator after it has been intentionally stopped by a workman for maintenance, or stopped by a building attendant at the end of the day, or a re-activation of the escalator after it has been stopped by one of its safety circuits being tripped by an unsafe operating condition, or by a safety circuit component malfunction being discovered, or stopped by loss of building power, or for any other reason. The safety check system surveys the start up circuits and all of the safety circuits that are not velocity-dependent before power is delivered to the escalator motor, as long as the main power switch has been turned on. The safety check system also includes an "on" delay timer which allows the system to survey all of the safety circuits that are velocity-dependent during the time period after the escalator motor has been started, but before the escalator has been brought to continuing normal operating speed. Thus the escalator will undergo some movement, such as inching or jogging, or even full operating speed while the velocity-dependent portion of the safety check system is still in operation after turning the start up key.

The system operates generally in the following manner. When the main power switch is "on", and the escalator motor is "off", the non-velocity-dependent safety circuit components are surveyed. Velocity-dependent safety circuits are also surveyed and checked to ensure that their state reflects a zero-speed condition. These are ongoing surveys that start shortly after movement of the escalator has been stopped. If any safety circuit does not pass the abote-noted survey, then power will not be delivered to the motor. If all of the safety circuits pass the above-noted survey, power is delivered to the motor through the start up key switch. When the motor start up key is turned, an "on"-delay four second timing cycle begins. The four second delay will ensure that the esclator will be able to reach full operating speed at the end of the start up delay; while at the same time allowing a comfortable time delay for the operator of the keyswitch who must hold the keyswitch closed for whatever start up time delay period is selected. Once power is delivered to the escalator motor, escalator components begin to move. These components may reach full operating speed while the speed-dependent safety circuits are surveyed and checked to ensure that their states change from a zero-speed condition to a full or partial operating speed. If one of the speed-dependent circuits, as for example the handrail speed monitoring device, does not show that the handrail speed is above a predetermined threshold, then the escalator cannot achieve a normal operating state, and will not be successfully started with the start up key. If all of the velocity-dependent circuits are found to be fully operational, then normal operating speed of the escalator will be maintained. This normal operating condition will be noted by the maintenance person when the start up key is released, and the escalator keeps running at normal operating speeds. If the keyswitch were to be held in the on position for a period of time beyond the four second start up delay period, or should become stuck in the on position, after fifteen seconds or some other appropriate period of time, the escalator will shut down, as described in U.S. Pat. No. 5,186,300 for safety purposes.

It is therefore an object of this invention to provide an escalator circuit checking system which is operable to confirm the state of all of the start up circuit components before and after the start up key has been turned in an attempt to start the escalator.

It is a further object of this invention to provide an escalator circuit checking system of the character described which is operable to confirm the state of escalator safety system circuit components before and after the start up key has been turned in an attempt to start the escalator.

It is another object of this invention to provide an escalator circuit checking system of the character described which will prevent starting of the escalator in the event that either the starting circuit or any of the safety circuits contain a component which is found to be in an inoperative state.

BRIEF DESCRIPTION OF THE DRAWINGS

These and other objects and advantages of the invention will become more readily apparent from the following detailed description of embodiments thereof, when taken in conjunction with the accompanying drawings that show several linked components of an escalator power supply circuit which is formed in accordance with this invention, and in which.

DESCRIPTION OF AN EMBODIMENT OF THE INVENTION

Figure 1:
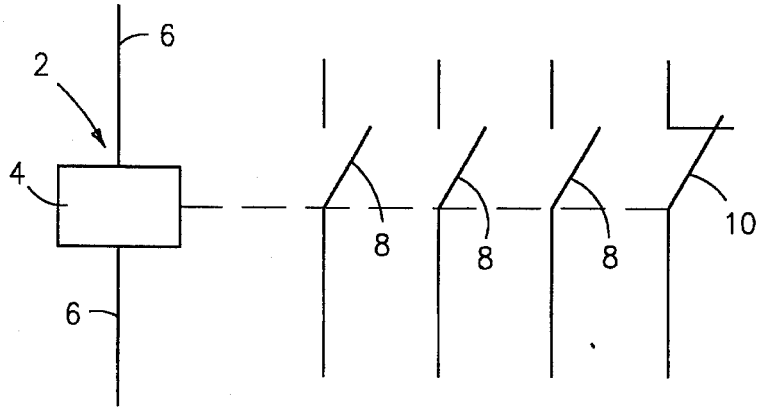
FIG. 1 is a diagram of a control relay for use in the system of this invention.

Referring now to the drawings, there is shown in FIGS. 1–4 the several relays that are preferred for use in the system of this invention. Each of the relays includes a coil which can be selectively energized or de-energized so as to change the state of the switches in the relay. The relay coils are either energized when power is supplied to the escalator, or de-energized when, power is supplied to the escalator. Each of FIGS. 1–4 shows the state of each switch dr contact, either closed or open, when the respective relay coils are de-energized. When the relay coils are energized, the coil-controlled switches will assume an opposite state. Normally, when an escalator is ready to be started by actuating the start up key, energizing power will be supplied to certain of the relays, and not to others of the relays. The following description of the various relays will identify which are normally energized and which are normally de-energized.

FIG. 1 shows a control relay denoted generally by the numeral 2. This relay includes a coil 4 which is selectively energized via line 6. The relay coil 4 is normally energized when the escalator is in a ready-to-start mode, therefore the switches 8 which are controlled by the coil 4 will be closed and the switch 10 will be open when the escalator is in a start up mode. Several relays of this type are included in the operating circuit, as will be noted hereinafter.

Figure 2:
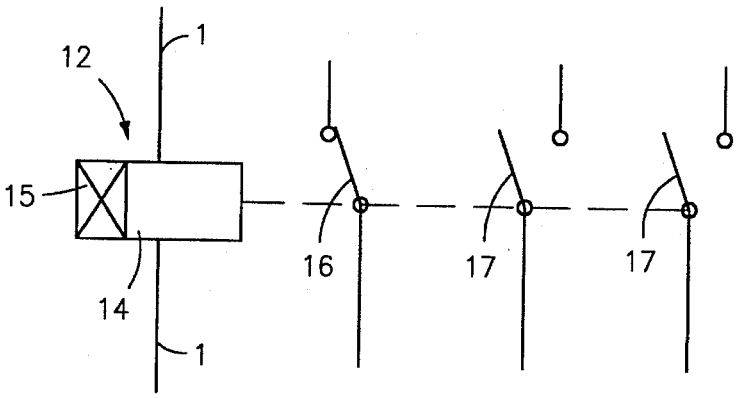
FIG. 2 is a diagram of an on-delay timer relay which is used in the system of this invention.

FIG. 2 shows an on-delay timer relay 12 which provides a time delay after the start up key is turned to start the escalator, during which time delay, power can be applied to the escalator motor only by holding the start-up key in the "on" position. The start up or "on-delay" timer relay 12 includes an on-delay timer circuit 15 which controls a relay that comprises a coil 14, a normally closed switch 16 and two normally open switches 17. When power is applied via line 1, the on-delay timer circuit starts its timing cycle. The relay coil 14 is energized and the switches 16 and 17 will change their state from that shown in FIG. 2 after the start up timing cycle has been completed. If power is removed from line 1 when the escalator is stopped, then the timing cycle will reset, the relay coil 14 will de-energize, and the switches 16 and 17 will revert to the state shown in FIG. 2. It is possible to apply power to line 1 and not energize the relay coil 14 by removing power from line 1 before the timing cycle has elapsed by releasing the start up keyswitch and stopping the escalator. The start up delay relay is used to allow velocity-dependent safety circuits to reach a state at which their proper operation can be verified. This requires that power be applied to the escalator motor in order for the escalator steps, handrail, and the like, to reach their normal operating speed.

Figure 3:
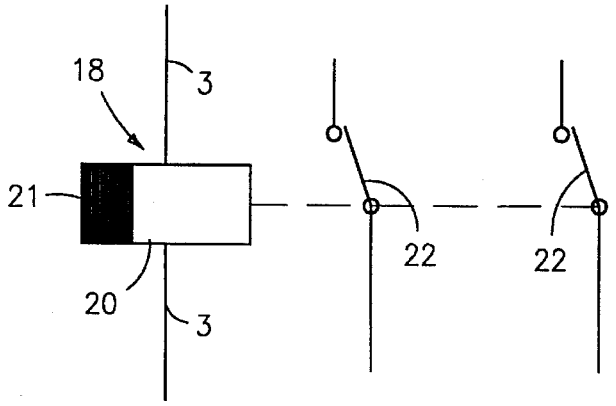
FIG. 3 is a diagram of an off-delay timer relay which is used in the system of this invention.

The numeral 20 of FIG. 3 denotes an off-delay timer relay coil for the off-delay timer relay 18. The off-delay timer circuit is denoted by the numeral 21. When power is applied via line 3 to the off-delay timer relay 18, the coil 20 is energized and the switches 22 change states from that shown in FIG. 3. When power is removed from line 3, which happens if the handrail (or some other moving component of the escalator) drops below a predetermined speed, the timer circuit 21 starts a two second off-delay timing cycle. Power is supplied for two seconds to the coil 20 by a capacitor or other energy storage device such as a battery (not shown) in the circuit 21. If the speed of the moving component rises above the predetermined speed during the two second period, then the relay coil Will remain energized, and the escalator will continue its normal operation. If the speed of the moving component does not rise above the predetermined speed during the two second period, the relay coil 20 will be de-energized and the switches 22 will revert to the state shown in FIG. 3 so that movement of the escalator will stop. As noted above, it is possible to remove power from line 3 and not de-energize the relay coil 20 by re-applying power to line 3 before the timing cycle has elapsed, if the handrail resumes its predetermined speed before the off-delay timer is able to interrupt power to the escalator motor. The specific offdelay timer relay coil 20 and its associated circuit shown in the drawings are operationally connected to a part of the handrail speed monitoring device. Similar relays can be used to monitor the speed of other moving parts of the escalator.

Figure 4:
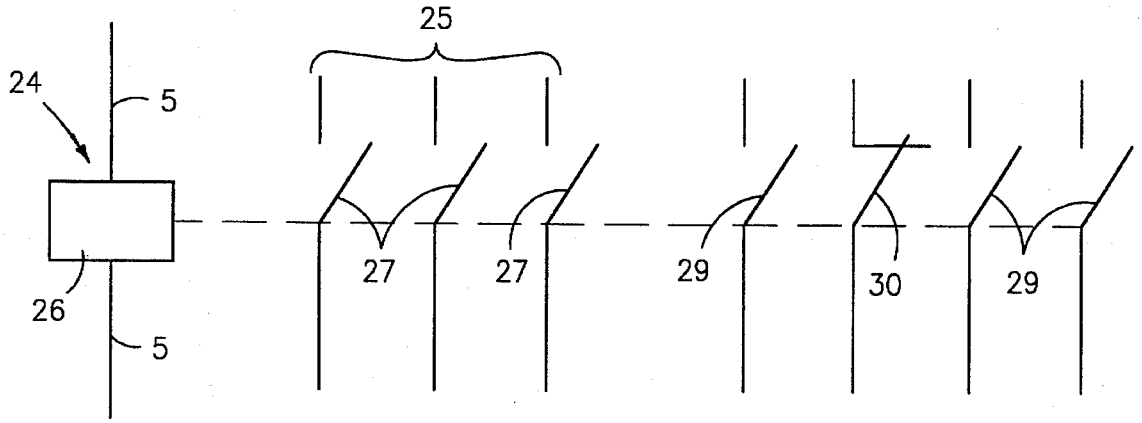
FIG. 4 is a diagram of an AC contactor relay for use in the system of this invention.

FIG. 4 shows a three pole AC contactor relay 24 which includes a coil 26 which controls three high current switches 27, and low current switches 29 and 30. The switches 27 and 29 will be in one state and the switch 30 will be in the opposite state, depending on whether the coil 26 is energized or de-energized. The three pole relay with its switches 27 is needed because of its high current capability which is able to handle the current amperages needed to operate the escalator motor. This relay will have its coil 26 de-energized when no voltage is applied and energized when voltage is applied. The switches which apply power to the escalator motor are controlled by this relay. Low current switches 29 and 30 are auxiliary devices which are operably coupled to the AC contactor relay 24. The high current switches 27 and low current switches 29 are normally open and the low current switch 30 is normally closed. Switches 27 control power to the escalator motor M which operates with relatively high currents from power lines 25; and the switches 29 and 30 control the relay and switch circuits, which operate with relatively low currents.

Figure 5:
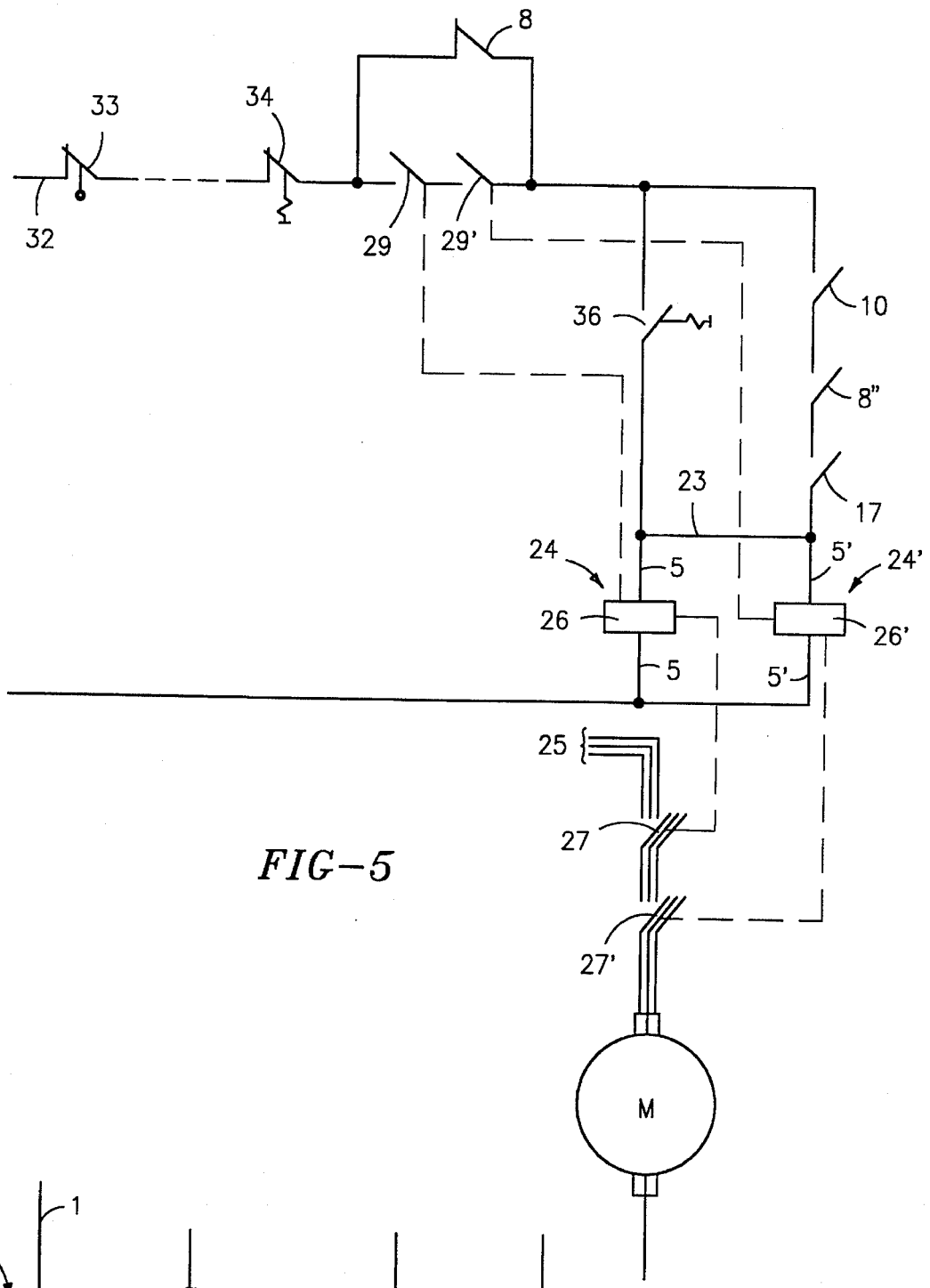
FIG. 5 is a circuit diagram of an escalator start up circuit linked with a circuit checking system formed in accordance with this invention.
Figure 7:
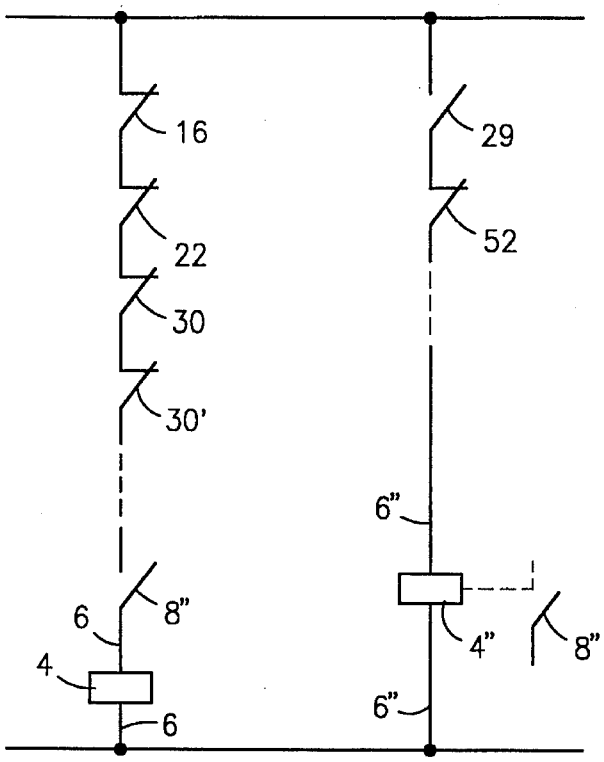
FIG. 7 is a circuit diagram of a safety check circuit used for determining the state of handrail speed monitoring safety circuit components, and/or other escalator safety circuits.
Figure 6:
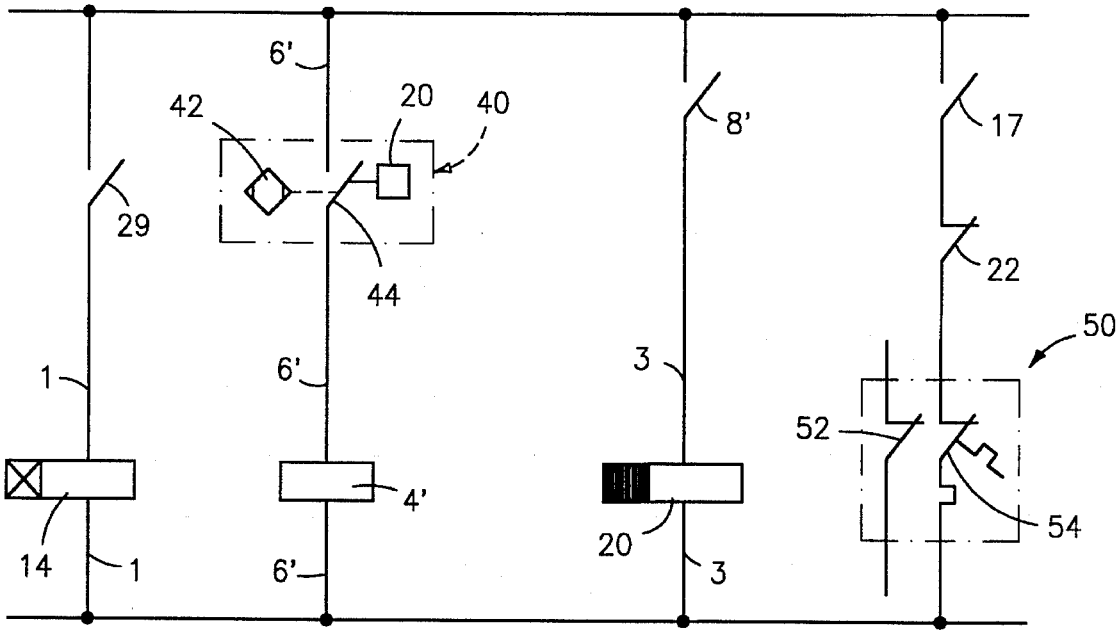
FIG. 6 is a circuit diagram of a handrail speed monitoring safety circuit in an escalator.

FIGS. 5–7 show various sections of the escalator motor start up circuit after the escalator main power switch (not shown) has been turned on, but before the motor start up keyswitch has been turned on start up power is supplied through line 32 which includes a normally closed limit switch 33 and a normally closed safety switch 34. The switch 34 is a manually operated switch which can be manually opened in the event of an operating emergency. The switch 33 can be a switch used in a safety device such as a skirt obstruction device, or the like. Other normally closed safety device limit switches can be connected in series with the switches 33 and 34. The switches 8 and 10 are control relay switches as shown in FIG. 1, the switch 8 being closed, and the switch 10 being opened when operating power is supplied to the control relay coil 4.

Referring to FIG. 5, when the manually operated start up key switch 36 is closed the initial "UP" (or "DOWN") relay coil 26 will be energized and switches 27 and 29 will close. The redundant "UP" (or "DOWN") relay coil 26' will also be energized via cross over line 23, and switches 27' and 29' will close. The switches 27, 27', 29 and 29' are shown in FIG. 4. The switches 29 shown in FIGS. 6 and 7 will also close, and the switches 30 and 30' will open. When the switches 30 and 30' open, the relay coil 4 will de-energize, and the switch 8 shown in FIG. 1 will open, while the switch 10 shown in FIG. 1 will close. Despite opening of switch 8, power will still be supplied to the relay coils 26 and 26' through switches 29 and 29' and cross over line 23. Thus the relay coils 26 and 26' will remain energized.

Reference is now had to FIG. 6, and particularly to a circuit breaker 50 shown therein. The circuit breaker 50 includes a pair of linked switches 52 and 54 which are normally closed, and which will both open only when an operating current overload is detected. These switches may be magnetically or thermally activated. As shown in FIG. 7, so long as operating current is at acceptable levels, the normally closed switch 52 will be operable to supply power to energize a control relay coil 4" via line 6" at such times when the switch 29 is closed. When the control relay coil 4" is energized, the switches 8" will close thereby setting up the redundant UP relay coil 26' up to be energized if the timer switch 17 closes.

Referring again to FIG. 6, the on-delay timer relay coil 14 will be energized via the switch 29 after the on-delay timing cycle elapses. When the on-delay timer relay coil 14 is energized, the switch 16 will open and the switches 17 will close. The switch 16 is included in the control of relay coil 4 circuit shown in FIG. 7 in order to verify the proper operation of the on-delay timer relay 12, since the on-delay relay coil 14 will be de-energized before the escalator is started, and the switch 16 will thus be closed before the escalator is started. Thus, the keyswitch 36 can only apply power to the relay coils 26 and 26' if the on-delay coil 14 is de-energized and the switch 16 is thus closed when the keyswitch 36 is turned to start the escalator.

Referring to FIG. 5 once again, so long as the control relay coil 4 is de-energized, the switch 10 will remain closed, and of ice the timer relay coil 14 is energized, the switches 17 will close. Thus, so long as the control relay coil 4 remains de-energized, the switch 10 will remain closed; and so long as the control relay 4" remains energized, the switches 8" will remain closed; and so long as the timer relay coil 14 remains energized, the switches 17 will remain closed. So long as the switches 29, 29', 10, 8" and 17 remain closed, no matter whether the key switch 36 is open or closed, the relay coils 26 and 26' will remain energized, and the switches 27 and 27' which provide operating current to the motor M will remain closed. It will be understood that the relay coil 26 will be energized via the cross over line 23 while switches 10, 8", and 17 remain closed. From the above, it will be appreciated that when the start up key switch 36 is turned, power will be supplied to the motor M and movement of the escalator components will begin. Initial escalator component movement will be slow so as to give the speed-dependent safety circuit components an opportunity to attain proper operating speed before continuous operating power is applied to the escalator motor M. As noted above, the normal safety circuit check delay is four seconds, so that the escalator operator will know to hold the start up key 36 closed for four seconds to allow the safety circuit check system to survey the safety circuits for proper operating condition. With aforesaid in mind, it will be understood that so long as the escalator operator holds the keyswitch 36 in the closed position, the relay coils 26 and 26' will remain energized. Thus the turning of the keyswitch 36 will begin motion of the escalator components. Whether such initial motion gives rise to normal escalator operation depends on the continuing state of the switches 10, 8" and 17. If any of these switches opens after the keyswitch 36 is released, then movement of the escalator will stop.

Reference is now had to FIGS. 3 and 6 for clarification of the operation of the off-delay timer relay 18 and its associated escalator components. The off-delay timer relays are operationally connected to speed-dependent safety components on the escalator, such as the handrail speed monitor, missing step detector, or the like. In FIG. 6, the specific speed-dependent safety component shown is the handrail speed sensor which is denoted generally by the numeral 40. The speed sensor 40 includes a sensing device 42 which may be a proximity sensor, or the like, and which senses the ongoing running speed of the handrail (not shown). The speed sensing device 42 is operably connected to a switch 44 which is normally open and which is on the line 6' which provides power to a control circuit relay 4' of the general type shown in FIG. 1. The relay 4' controls a normally open switch 8' which is on the line 3 that supplies power to the off-delay timer relay coil 20.

The normally open switch 44 is also operably connected to an off-delay timer relay 20' which provides a forty five (or other length) second delay after the main power switch is initially turned on to start the escalator. This timer relay 20' will show an actual running condition (which of course does not exist) of the escalator for the forty five second time period, commencing with turning the main power switch "on". The switch 44 will thus be closed for the forty five second period immediately following the activation of the main power switch. This will hold the control relay 4' in an energized state for the forty five second period. The switch 8' will close and the off-delay timer relay coil 20 will energize. Switch 22 will open and relay coil 4 will de-energize. Switch 8 will open, removing power from key switch 36. The reason for providing this initial delay is to allow maintenance or other operating personnel time to make sure that it is safe to turn the power key switch 36 to attempt to start the motor M. If the key switch 36 is turned during the initial forty five second time period, nothing will happen. After the forty five second time period has elapsed, the relay coil 20' will de-energize, and the switch 44 will open. The coil 4' will de-energize, switch 8' will open, coil 20 will de-energize after two seconds, Switch 22 will close, coil 4 will energize and switch 8 will close thereby bringing power to the keyswitch 36.

After the initial forty five second delay, the state of the switch 44 is controlled by the handrail speed sensing device 42. It will be appreciated that at the end of the initial forty five second delay, the on-delay circuits described above can be energized, and can commence their normal operation, The switch 44 will remain open until the speed sensing device 42 detects that the handrail has reached a predetermined threshold speed, at which time the sensing device 42 will close the switch 44. When the switch 44 closes, the control relay 4' will be energized and the switch 8' will close so as to energize the off-delay relay coil 20. So long as the off-delay relay coil 20 remains energized, the switches 22 will remain open. So long as the switches 22 remain open, the circuit breaker 50 cannot be tripped.

From the aforesaid description, it will be understood that after the keyswitch 36 is released, so long as the switches 10, 8" and 17 remain closed, the switches 27 and 27' will continue to allow power to the motor M and the escalator will continue to run, provided that the escalator is not stopped for other reasons. The switch 10 will remain closed so long as the control relay doll 4 remains de-energized; the switch 8" will remain closed so long as the control relay coil 4" remains energized; and the switch 17 will remain closed so long as the on delay relay coil 14 remains energized. As previously noted, as long as the speed sensing device 42 indicates an acceptable speed for the handrail, the switch 44 will remain closed, and the control relay coil 4' will remain energized. Should the speed sensing device 42 detect an unacceptable handrail speed, the switch 44 will open. The control relay coil 4' will be de-energized and the switch 8' will open. The off-delay relay coil 20 will continue to be energized for a two second time period (or whatever other delay period is desired and preset into the off delay timer circuit 21 ) thereby holding the switch 22 open. If the switch 44 does not reclose during the delay period, the control relay coil 4' will be de-energized at the end of the delay period, and the switch 8' will be open. This will de-energize the off delay relay coil 20 causing the switch 22 to close. At this point in time, both switches 17 and 22 will be closed causing the circuit breaker 50 to trip thereby opening the switch 52. When the switch 52 opens, the control relay coil 4" will de-energize and the switch 8" will open so as to interrupt power to the motor M. The escalator will then stop, and the on delay relay 12 will be returned to its initial state. The control relay 2 will be returned to its initial state only after the circuit breaker 50 is manually reset. This will re-energize the coil 4" and close the contact 8", thus re-energizing coil 4. In the event that the switch 44 recloses during the off delay period as a result of the handrail resuming an acceptable speed, nothing will happen and the escalator will continue to run.

As noted above, there will be several component speed dependent circuits in the system, and actuation of any of them can result in stopping the escalator. The handrail speed detector 40 described is merely illustrative of the manner in which each of the speed dependent components operate. When the escalator is restarted, the above-described circuit checking protocol will be repeated.

Figure 8:
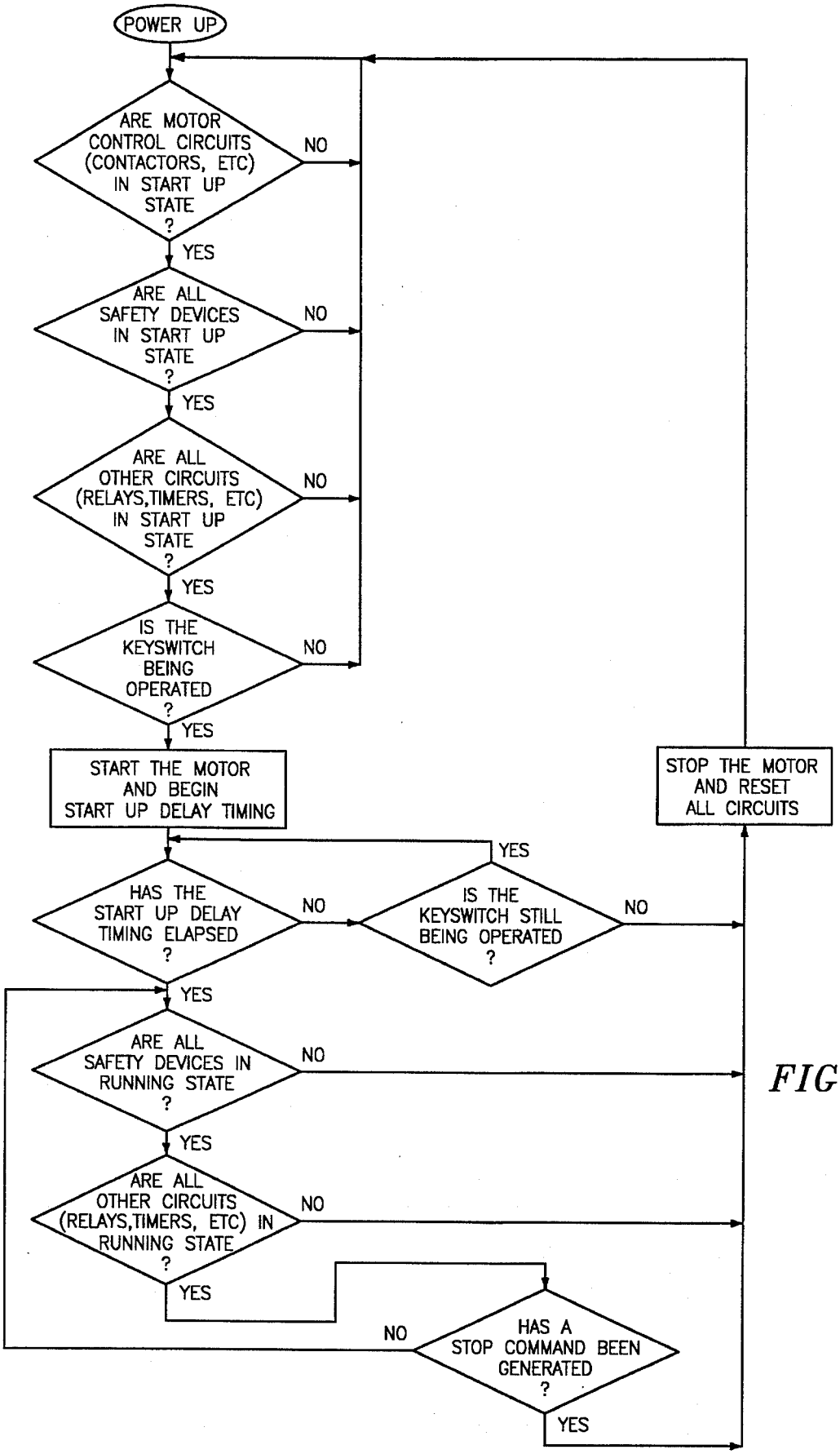
FIG. 8 is a logic diagram for programming a microprocessor controller for operating the system of this invention.
Figure 9:
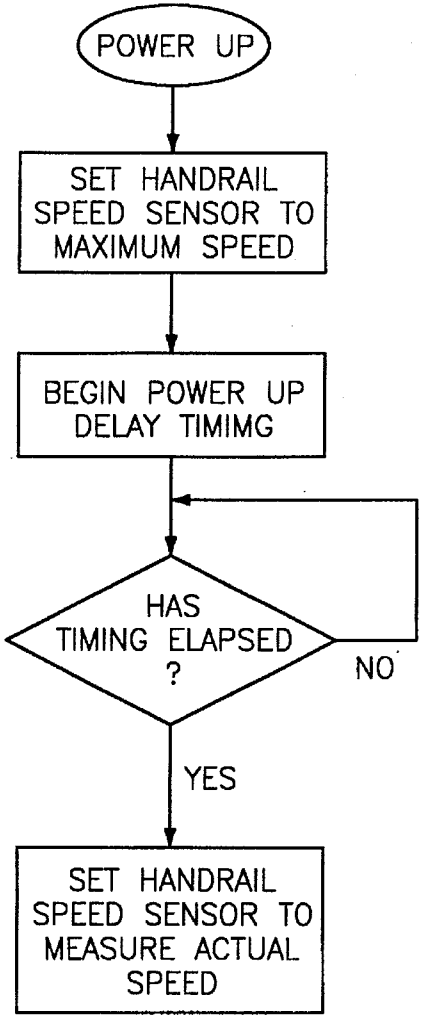
FIG. 9 is a logic diagram similar to FIG. 8, but showing the controller logic for operating the power up delay portion of the system of this invention.
Figure 10:
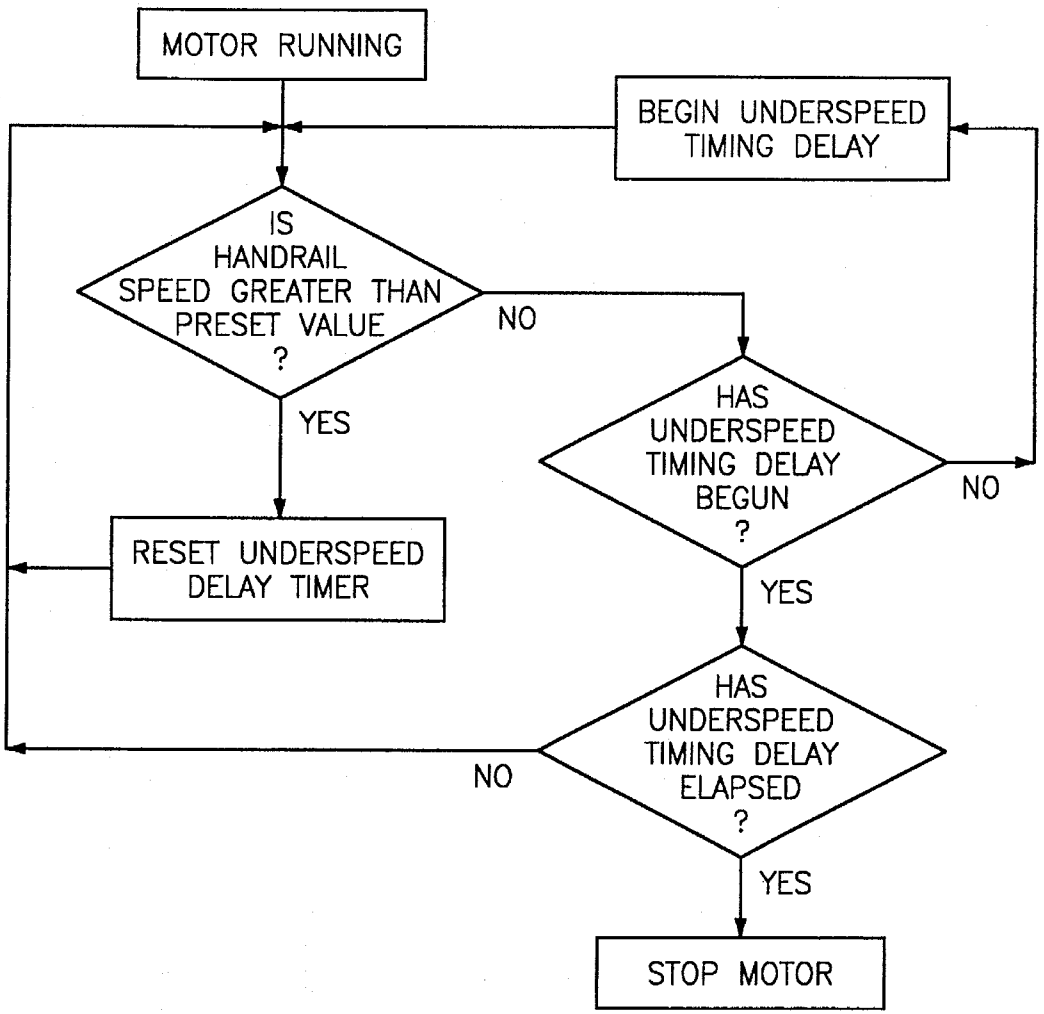
FIG. 10 is a logic diagram similar to FIG. 9, but showing the controller logic for operating the off-delay portion of the system of this invention which is governed by the handrail speed monitor.

FIG. 8–10 are schematic representations of a software programs which may be programmed into an escalator microprocessor controller if the safety check system components were formed from microprocessor-controlled solid state components.

It will be readily appreciated that the; safety circuit check system of this invention could also be used in an elevator system to check elevator safety circuit component operation. The system of this invention will ensure that the safety circuits are all operating in a normal manner before the passenger conveyor can be started and operated in its normal mode. The system will also ensure that transient out-of-specification variations in the speed of moving components of the conveyor, which variations do not continue for a predetermined period of time, will not stop the conveyor, therefore nuisance interruptions of service will be prevented.

Since many variations of the disclosed embodiment of the invention may be made without departing from the inventive concept, it is not intended to limit the invention otherwise than as required by the appended claims.

What is claimed is:

1. A passenger transporting assembly having a motor, a plurality of passenger safety circuits including at least one speed-dependent safety circuit, a master power switch, and a manually operated keyswitch, said transporting assembly comprising:

a) means for determining whether motor control circuit components in said assembly are in a start up state when said master power switch has been closed;

b) means for determining whether said passenger safety circuits are in a start up state when said master power switch has been closed;

c) means for delivering start up power to said motor when said keyswitch has been closed and said motor contact circuit components and said passenger safety circuits are all determined to be in a start up state;

d) means for delivering power to a start up delay timer means when start up power is applied to said motor;

e) means for determining whether said speed-dependent safety circuits are operating at full running speed;

f) means for determining whether said start up delay timer means is energized; and g) means for interrupting power to said motor when said speed-dependent safety circuits are determined to be operating at less than full running speed during operation of said start up delay timer means, and when said keyswitch has been released after start up of the motor.

2. The passenger transporting assembly of claim 1 wherein said start up delay timer means further includes means for determining whether additional assembly circuits are operating in a full running state, and wherein said means for interrupting power is operable to interrupt power to said motor when said additional assembly circuits are determined to be operating in less than a full running state when said keyswitch has been released after start up of the motor.

3. The passenger transporting assembly of claim 1 further including means to de-energize both of said means for determining specified in parts a) and b) when start up power is delivered to said motor.

4. The passenger transporting assembly of claim 3 further including means to re-energize each of said means for determining specified in parts a) and b) when power to said motor is interrupted.

5. The passenger transporting assembly of claim 1 further comprising off-delay timer means including means for detecting less than full speed operation of a speed-dependent safety circuit component; means for supplying power to said motor during a preset delay period when less than full speed operation of a speed-dependent safety circuit is detected; and means for interrupting power to said motor when less than full speed operation of a speed-dependent safety circuit component continues for a period of time which exceeds said preset delay period.

6. A passenger transporting assembly having a motor, a plurality of passenger safety circuits including at least one speed-dependent safety circuit, a master power switch, and a manually operated keyswitch, said transporting assembly comprising:

a) off-delay timer means including means for detecting less than full speed operation of a speed-dependent safety circuit component;

b) means for supplying power to said motor during a preset delay period when less than full speed operation of a speed-dependent safety circuit is detected; and c) means for interrupting power to said motor when less than full speed operation of a speed-dependent safety circuit component continues for a period of time which exceeds said preset delay period.

7. A method for operating a passenger transporting assembly having a motor, a plurality of passenger safety circuits including at least one speed-dependent safety circuit, a master power switch, and a manually operated keyswitch, said method comprising the steps of:

a) determining whether motor control circuit components in said assembly are in a start up state when said master power switch has been closed;

b) determining whether said passenger safety circuits are in a start up state when said master power switch has been closed;

c) delivering start up power to said motor when said keyswitch has been closed and said motor contact circuit components and said passenger safety circuits are all determined to be in a start up state;

d) delivering power to a start up delay timer means when start up power is applied to said motor, and thereafter determining whether speed-dependent safety circuits are operating at full running speed;

e) determining whether said start up delay timer means is energized; and f) interrupting power to said motor when said speed-dependent safety circuits are determined to be operating at less than full running speed during operation of said start up delay timer means, and when said keyswitch has been released after start up of the motor.

8. The method of claim 7 further including the steps of determining whether additional assembly circuits are operating in a full running state; and interrupting power to said motor when said additional assembly circuits are determined to be operating in less than a full running state when said keyswitch has been released after start up of the motor.

9. The method of claim 7 further comprising the step of de-energizing both of said determining steps specified in parts a) and b) when start up power is delivered to said motor.

10. The method of claim 9 further including the step of re-energizing each of said determining steps specified in parts a) and b) when power to said motor is interrupted.

11. The method of claim 7 comprising the further steps of:

g) detecting less than full speed operation of a speed-dependent safety circuit component;

h) supplying power to said motor during a preset delay period when less than full speed operation of a speed-dependent safety circuit is detected; and i) interrupting power to said motor when less than full speed operation of a speed-dependent safety circuit component continues for a period of time which exceeds said preset delay period.

12. A method for operating a passenger transporting assembly having a motor, a plurality of passenger safety circuits including at least one speed-dependent safety circuit, a master power switch, and a manually operated keyswitch, said method comprising the steps of:

a) detecting less than full speed operation of a speed-dependent safety circuit component;

b) supplying power to said motor during a preset delay period when less than full speed operation of a speed-dependent safety circuit is detected; and c) interrupting power to said motor when less than full speed operation of a speed-dependent safety circuit component continues for a period of time which exceeds said preset delay period.

13. A method for operating a passenger transporting assembly having a motor, a plurality of passenger safety circuits including at least one speed-dependent safety circuit, a master power switch, and a manually operated keyswitch, said method comprising the steps of simulating full speed operation of the assembly for a predetermined time period after the master power switch is initially turned on thereby disabling said manually operated keyswitch from being used to energize the motor during said predetermined time period.

14. The method of claim 13 wherein said simulating step is accomplished by closing a switch which is normally closed by said speed-dependent safety circuit when the transporting assembly is operating at normal operating speeds.

15. A passenger transporting assembly having a motor, a plurality of passenger safety circuits including at least one speed-dependent safety circuit, a master power switch, and a manually operated keyswitch, said transporting assembly comprising delay timer means operable to simulate normal operating speeds for the transporting assembly for a preset period of time after said master power switch is initially turned on thereby disabling said manually operated keyswitch from delivering power to the motor for said preset period of time.

16. The passenger transporting assembly of claim 15 wherein said delay timer means closes a switch which is normally closed by a speed-dependent safety circuit when the transporting assembly is operating at normal speeds, and wherein said delayf timer means opens said switch after said preset period of time.

* * * * *